US008985965B2

(12) United States Patent
Vlachos

(10) Patent No.: US 8,985,965 B2
(45) Date of Patent: Mar. 24, 2015

(54) CYCLONIC ELEVATOR AND METHOD FOR USING SAME

(71) Applicant: Greg J. Vlachos, Thousand Oaks, CA (US)

(72) Inventor: Greg J. Vlachos, Thousand Oaks, CA (US)

( * ) Notice: Subject to any disclaimer, the term of this patent is extended or adjusted under 35 U.S.C. 154(b) by 0 days.

(21) Appl. No.: 13/921,985

(22) Filed: Jun. 19, 2013

(65) Prior Publication Data

US 2015/0004007 A1 Jan. 1, 2015

Related U.S. Application Data

(63) Continuation of application No. PCT/US2011/066629, filed on Dec. 21, 2011.

(60) Provisional application No. 61/427,036, filed on Dec. 23, 2010.

(51) Int. Cl.

| | |
|---|---|
| ***F04F 5/46*** | (2006.01) |
| ***F04F 5/42*** | (2006.01) |
| ***F04F 5/00*** | (2006.01) |

(52) U.S. Cl.

CPC . *F04F 5/00* (2013.01); *F04F 5/466* (2013.01); *F04F 5/46* (2013.01); *F04F 5/42* (2013.01); *Y10T 29/49236* (2015.01)

USPC ..... 417/171; 417/76; 417/87; 417/179; 417/197; 417/198

(58) Field of Classification Search

CPC ..... E02F 3/9231; F04F 5/14; F04F 5/26; F04F 5/28; F04F 5/467; F04F 5/42

USPC ..... 417/76, 87, 171, 179, 197, 198

See application file for complete search history.

(56) References Cited

U.S. PATENT DOCUMENTS

| | | | | | |
|---|---|---|---|---|---|
| 640,463 | A | * | 1/1900 | Gildea | 417/172 |
| 3,186,146 | A | * | 6/1965 | Latham, Jr. | 96/313 |
| 3,301,606 | A | * | 1/1967 | Bruno | 406/85 |
| 3,672,790 | A | * | 6/1972 | Roseby et al. | 417/108 |
| 3,857,651 | A | * | 12/1974 | Bruno | 417/171 |
| 4,227,863 | A | | 10/1980 | Sommerer | |
| 4,487,553 | A | * | 12/1984 | Nagata | 417/171 |
| 2009/0324429 | A1 | * | 12/2009 | Azimov | 417/198 |

FOREIGN PATENT DOCUMENTS

FR 1 200 145 A 12/1959

* cited by examiner

*Primary Examiner* — Peter J Bertheaud
*Assistant Examiner* — Dominick L Plakkoottam
(74) *Attorney, Agent, or Firm* — Norton R. Townsley; Belasco, Jacobs & Townsley LLP

(57) ABSTRACT

A cyclonic elevator tube comprising a manifold which supplies fluid under pressure via an annular transition ring with multiple, circumferentially spaced jet orifices. These orifices are set at inwardly and circumferentially directed compound angles for ejecting vortex jets of pressurized fluid through the elevator, to ultimately cause transportation of fluid material through the tubes. This apparatus comprises: a cylindrical chamber; a plurality of helically shaped venturi tubes spaced around the internal circumference of the chamber; a manifold connected to the inlet ends of the venturi tubes; and a high pressure gas supply connected to the manifold. The helix can be right or left handed and preferably the venturi tubes extend for less than one turn of the helix. The angle that the tangent of the helix makes with the longitudinal axis of the chamber is between 1° and 89°. The internal circumference of the chamber may be larger at the inlet end than at the outlet end.

26 Claims, 21 Drawing Sheets

CYCLONIC ELEVATOR AND METHOD FOR USING SAME

CROSS REFERENCE TO RELATED APPLICATIONS

This application is a continuation of PCT Application No. PCT/US2011/066629, filed 21 Dec. 2011 which claims priority to U.S. Provisional Application No. 61/427,036, filed 23 Dec. 2010. The entire specification, claims and drawings of Application No. PCT/US2011/066629 and Application No. 61/427,036 are hereby incorporated herein by reference.

BACKGROUND OF THE INVENTION (1) Field of the Invention

The present invention is for an improved cyclonic elevator. More particularly, this cyclonic elevator includes helical venturis and will be primarily used for pumping fluid.

(2) Description of the Related Art

The closest prior art to this invention is U.S. Pat. No. 3,857,651 to Bruno Dec. 31, 1974 and U.S. Pat. No. 3,301,606 to Bruno, Jan. 31, 1967.

U.S. Pat. No. 3,857,651 discloses coaxial pumping units for cylindrical cyclonic elevator tubes in which a manifold circumscribing the latter for supplying fluid under pressure thereto has communication therewith via an annular transition ring provided with a plurality of circumferentially spaced jet orifices set at inwardly and circumferentially directed compound angles for ejecting vortically directed jets of fluid under pressure through the tubular elevator to effect transportation of comminuted and/or fluid material through such tubes.

U.S. Pat. No. 3,301,606 relates to a cyclonic elevator device wherein particulate material is raised by means of a rotating, pulsing air column. It comprises a tube for lifignt the material, at least one chamber surrounding the tube, a plurality of passages leading from the chamber to the interior of the tube arranged about the tube in a spiral pattern, and means for introducing compressed air to the chamber and through the passages to impart a swirling motion to the material being lifted through the tube.

This invention is a great improvement over the Bruno patents.

SUMMARY OF THE INVENTION

The present invention is a cyclonic elevator comprising: a cylindrical chamber; a plurality of helically shaped venturi tubes spaced around the internal circumference of the chamber; a manifold connected to the inlet ends of the venturi tubes; and a high pressure gas supply connected to the manifold.

The helix can be right or left handed and preferably the venturi tubes extend for less than one turn of the helix. The angle that the tangent of the helix makes with the longitudinal axis of the chamber is between 1° and 89°. The internal circumference of the chamber may be larger at the inlet end than at the outlet end.

A nozzle may be attached to the inlet end of the chamber. The nozzle circumference may larger at the nozzle inlet end than at the nozzle outlet end. Preferably there are openings in the side wall of the nozzle.

Two or more of these chambers may be connected together in series with tubing to form a high capacity pump.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

There are two principles that must be grasped to fully understand this invention and how it works. These are the venturi effect and helices.

According to the laws governing fluid dynamics, a fluid's velocity must increase as it passes through a constriction to satisfy the conservation of mass, while its pressure must decrease to satisfy the conservation of energy. Thus any gain in kinetic energy a fluid may accrue due to its increased velocity through a constriction is negated by a drop in pressure. An equation for the drop in pressure due to the Venturi effect may be derived from a combination of Bernoulli's principle and the continuity equation.

The limiting case of the Venturi effect is when a fluid reaches the state of choked flow, where the fluid velocity approaches the local speed of sound. In choked flow the mass flow rate will not increase with a further decrease in the downstream pressure environment.

However, mass flow rate for a compressible fluid can increase with increased upstream pressure, which will increase the density of the fluid through the constriction (though the velocity will remain constant). This is the principle of operation of a de Laval nozzle.

Figure 1:
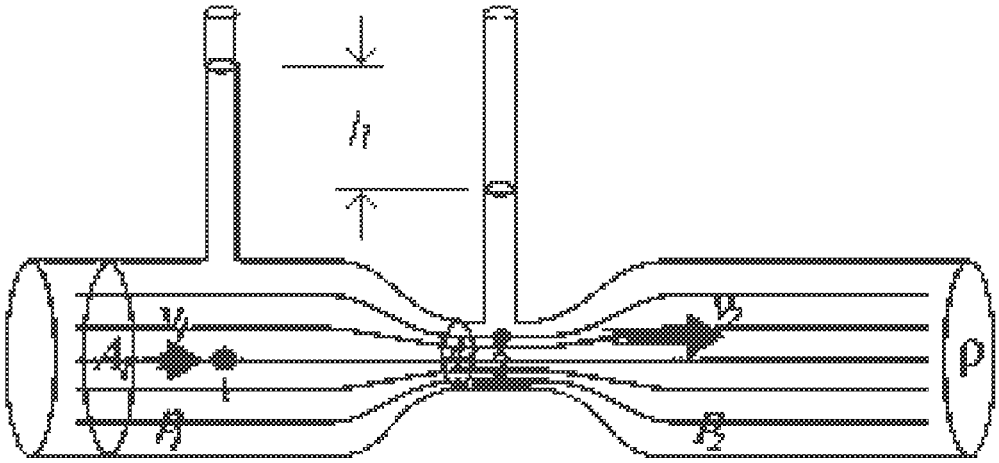
FIG. 1 illustrates venturi effect.

Referring to FIG. 1, using Bernoulli's equation in the special case of incompressible flows (such as the flow of water or other liquid, or low speed flow of gas), the theoretical pressure drop (p1−p2) at the constriction would be given by:

$$\frac{p}{2}(v_2^2 - v_1^2)$$

where is the density of the fluid, v1 is the (slower) fluid velocity where the pipe is wider, v2 is the (faster) fluid velocity where the pipe is narrower. This assumes the flowing fluid (or other substance) is not significantly compressible—even though pressure varies, the density is assumed to remain approximately constant.

A helix is a type of space curve, i.e. a smooth curve in three-dimensional space. It is characterized by the fact that the tangent line at any point makes a constant angle with a fixed line called the axis.

Helices can be either right-handed or left-handed. With the line of sight along the helix's axis, if a clockwise screwing motion moves the helix away from the observer, then it is called a right-handed helix; if towards the observer then it is a left-handed helix. A right-handed helix cannot be turned or flipped to look like a left-handed, and vice versa.

The pitch of a helix is the width of one complete helix turn, measured parallel to the axis (Z in FIG. 2) of the helix.

A circular helix, (i.e. one with constant radius) has constant band curvature and constant torsion.

Figure 2:
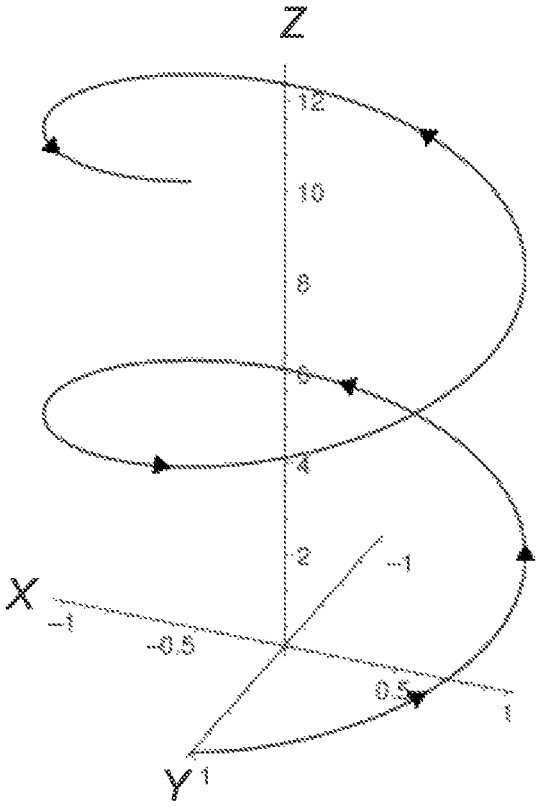
FIG. 2 shows the helix (cos t, sin t, t) from t=0 to 4π.
Figure 3:
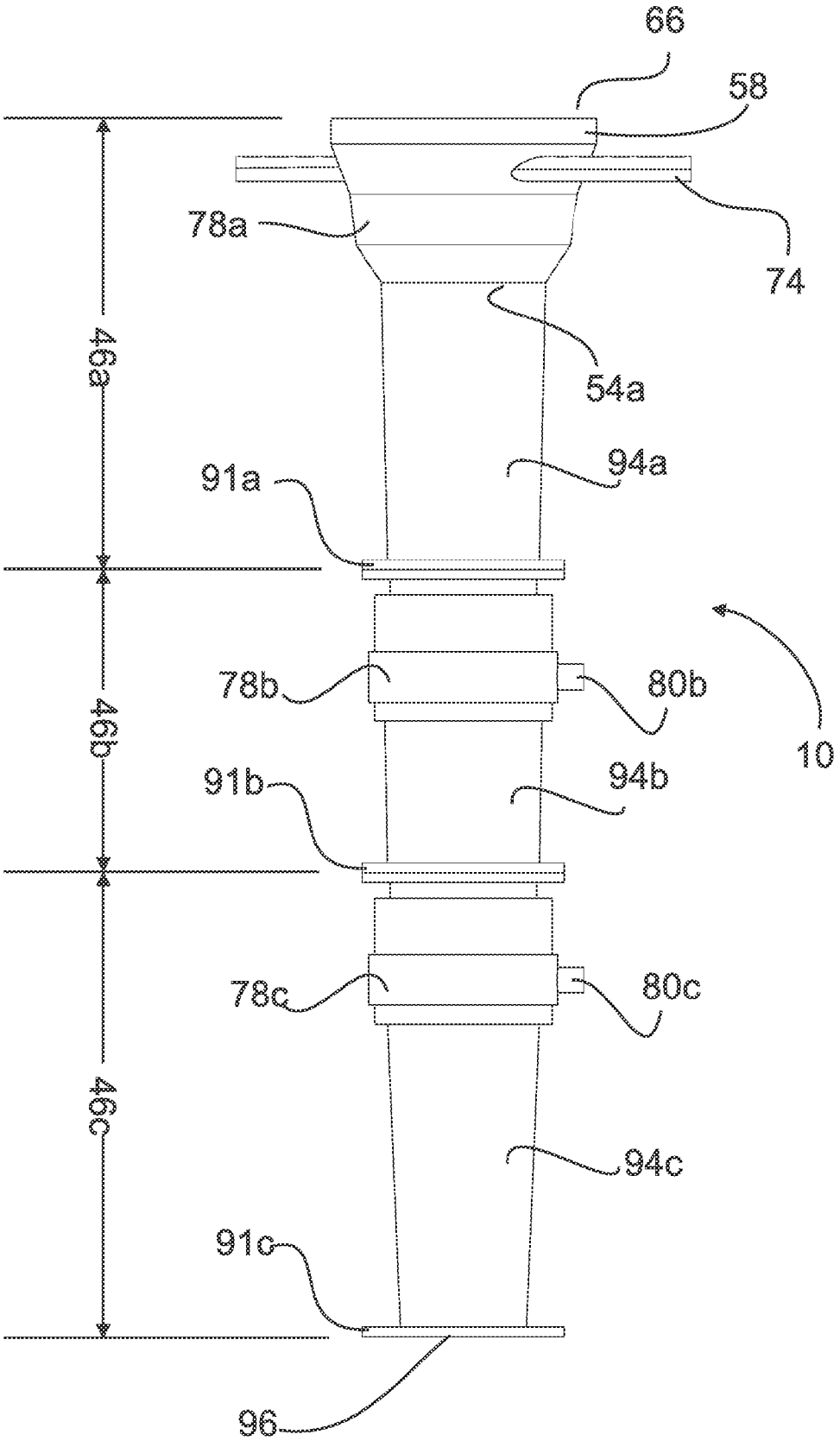
FIG. 3 is a side view of a three stage version of this invention.
Figure 4B:
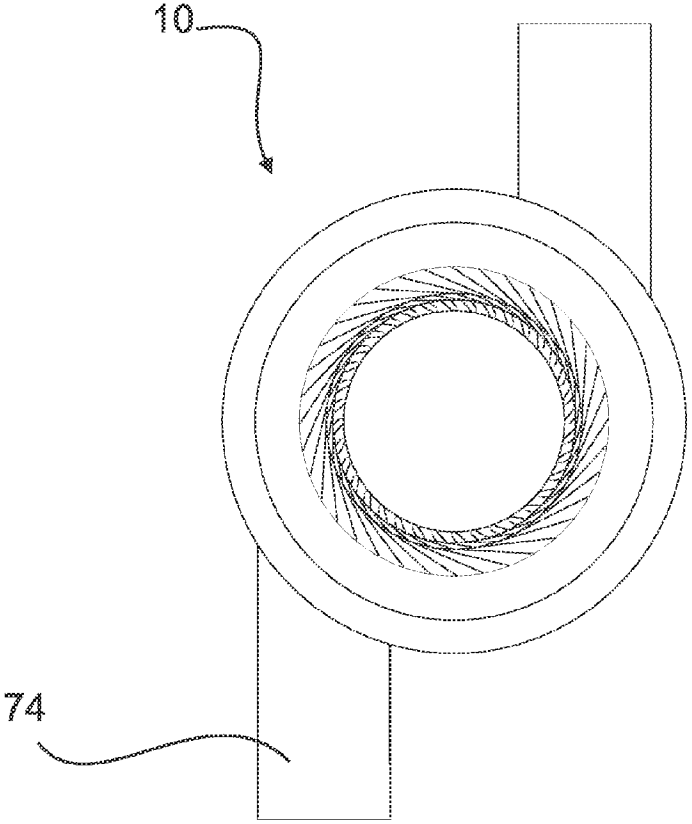
FIG. 4B is an end view of the three stage version of this invention.
Figure 4A:
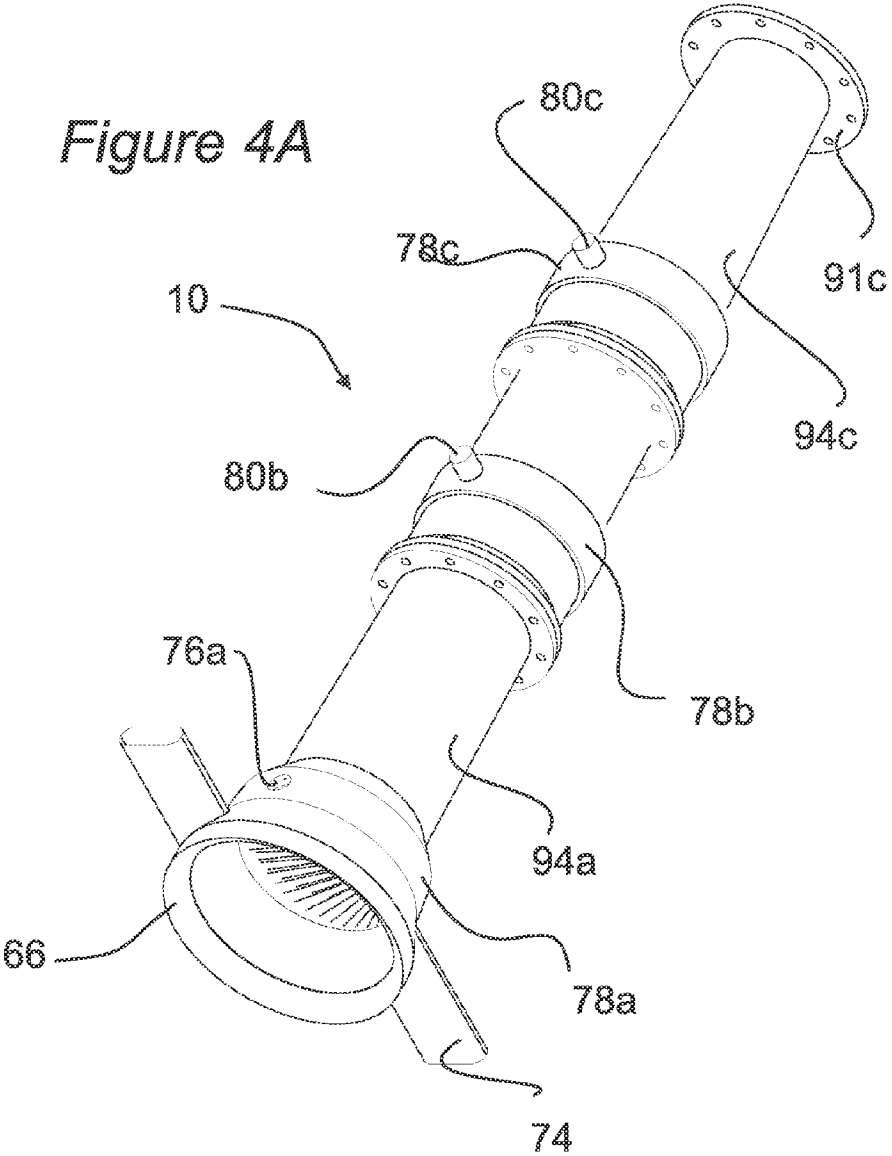
FIG. 4A is a perspective view from the inlet end of the three stage version of this invention.
Figure 5:
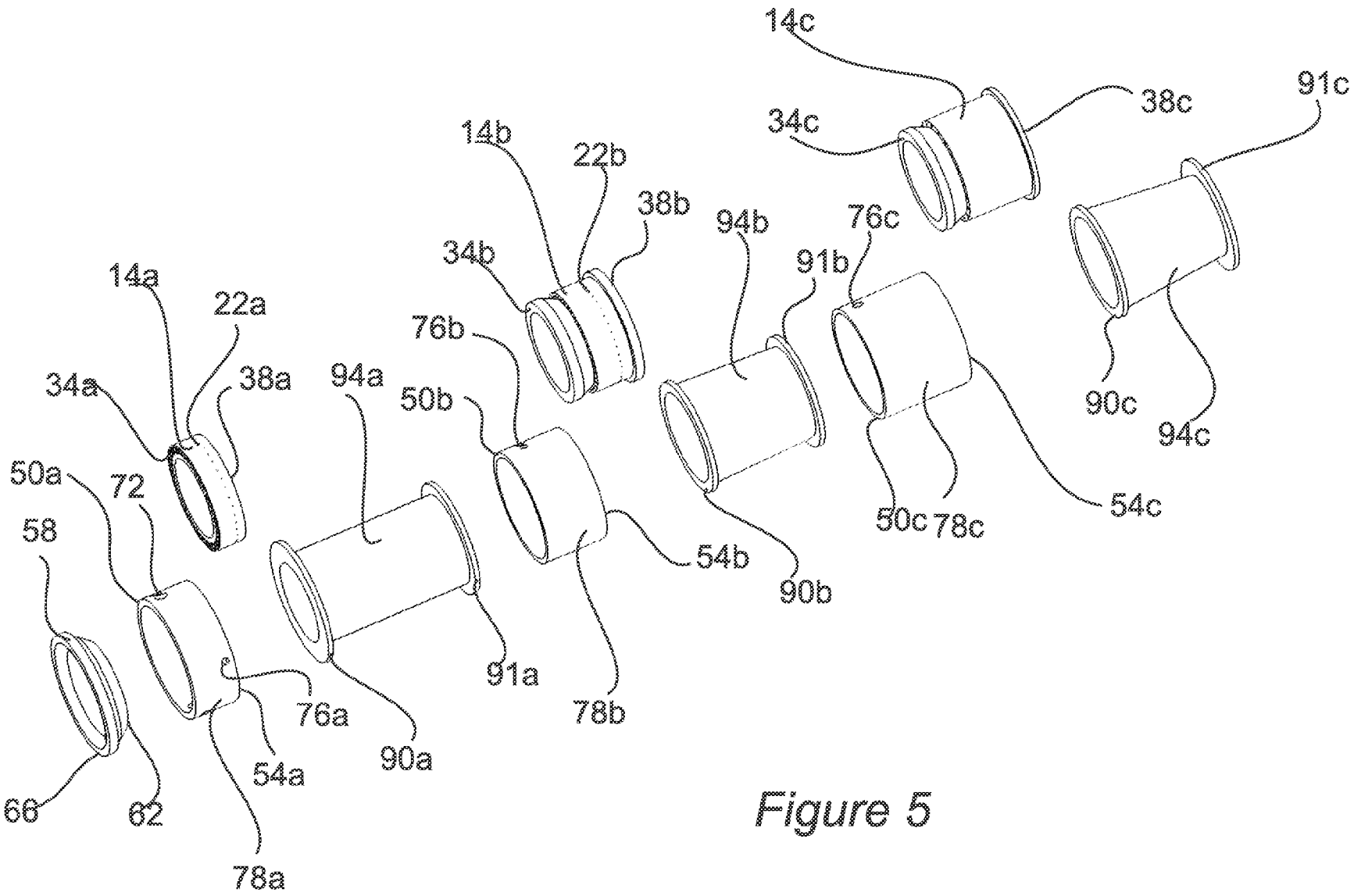
FIG. 5 is a perspective, off center view of the segments comprising the three stage version of this invention.
Figure 6:
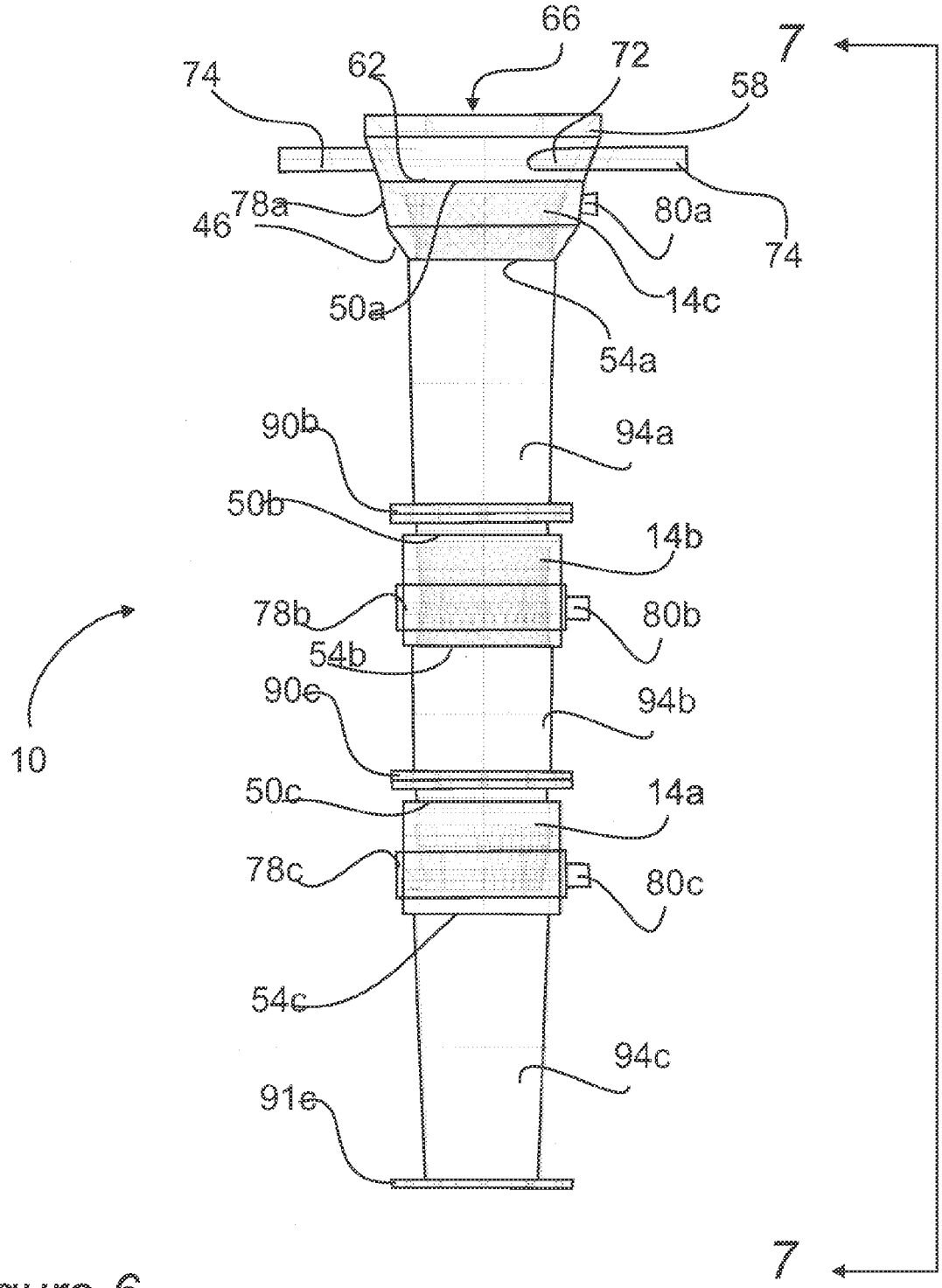
FIG. 6 is a side view of the three stage version of this invention showing some of its internal structure.
Figure 7:
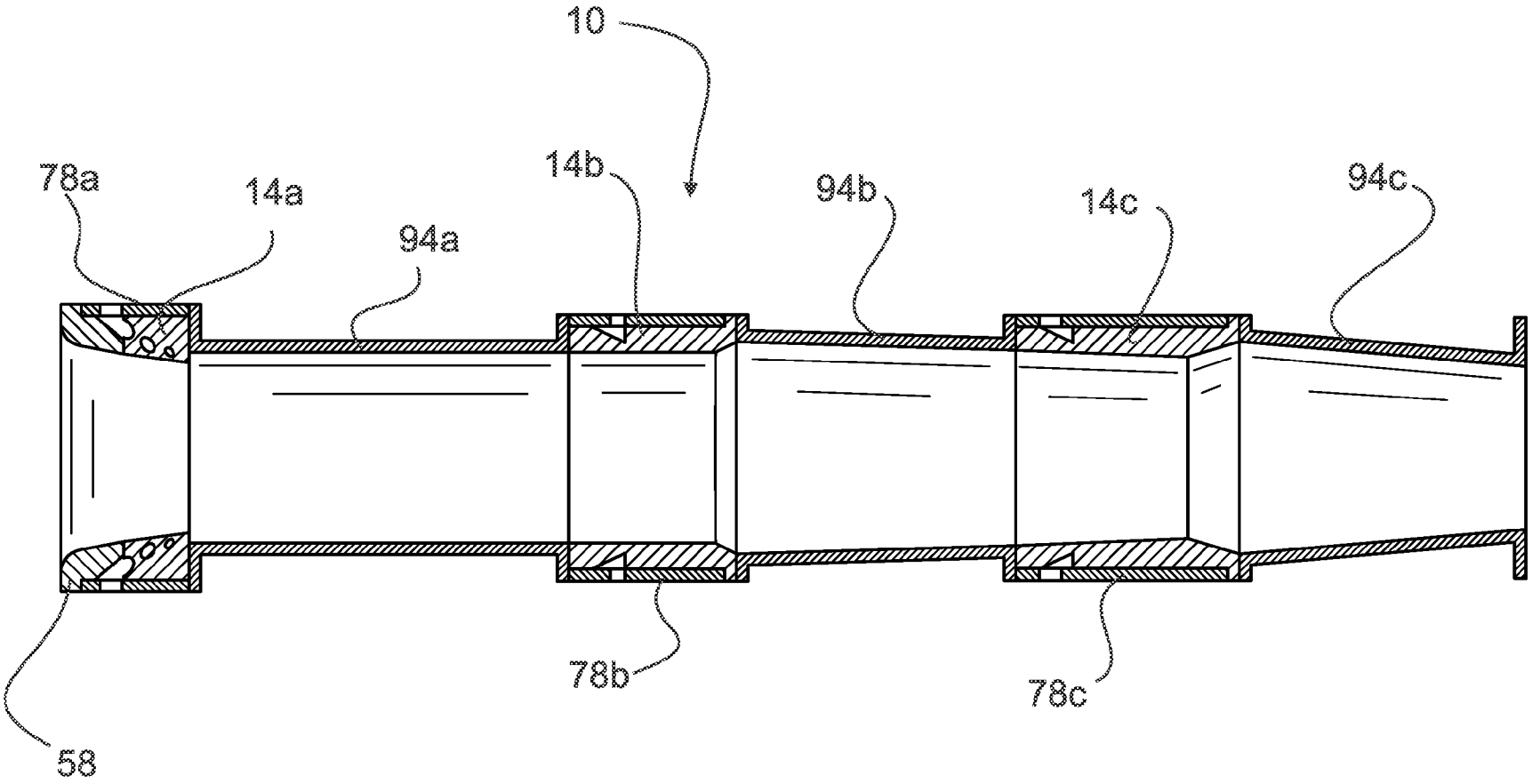
FIG. 7 is a longitudinal cross section along the line 7-7 of FIG. 6
Figure 8A:
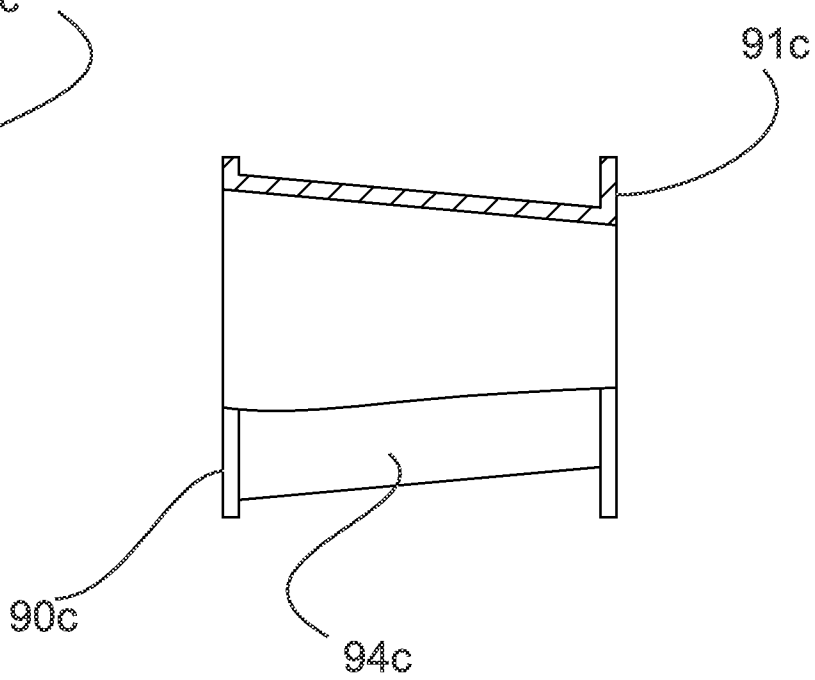
FIG. 8A is a side, partially cut away view of the outlet tube of the invention.
Figure 8B:
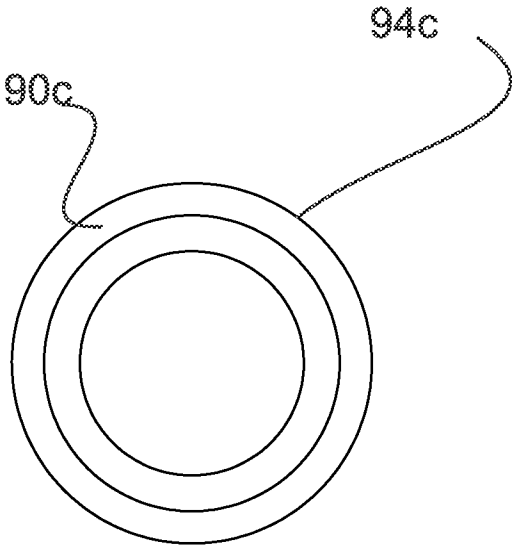
FIG. 8B is an end view of the outlet tube of the invention.
Figures 9A, 9B, 9C, 9D, 9E:
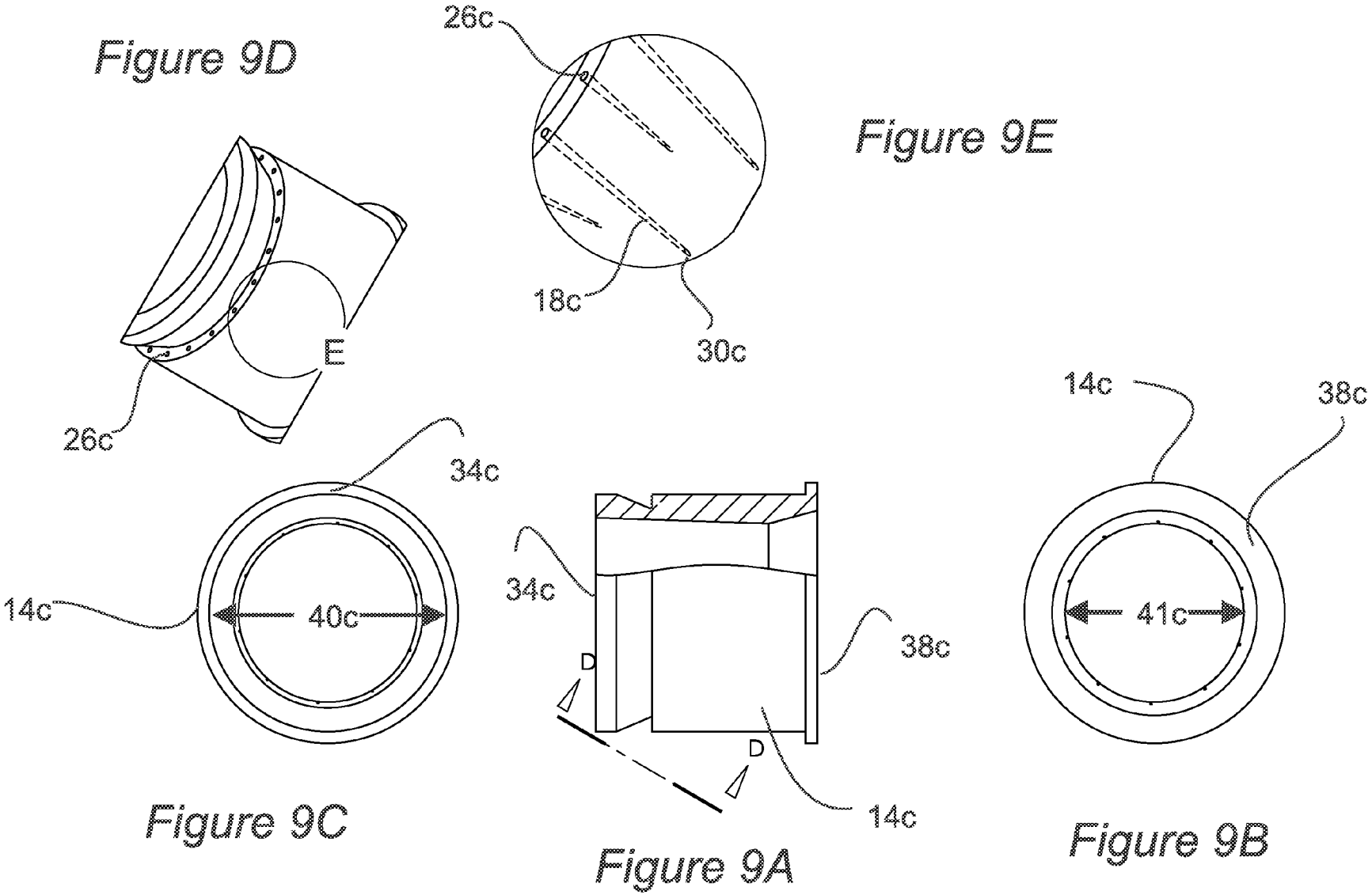
FIG. 9A is a side, partially cut away view of the uppermost venturi chamber of the three stage version of this invention.
FIG. 9B is an end view of the uppermost venturi chamber of the three stage version of this invention from one end.
FIG. 9C is an end view of the uppermost venturi chamber of the three stage version of this invention from the other end.
FIG. 9D is a view along the lines D-D of FIG. 9A.
FIG. 9E is an enlargement detail E on FIG. 9D.
Figure 10B:
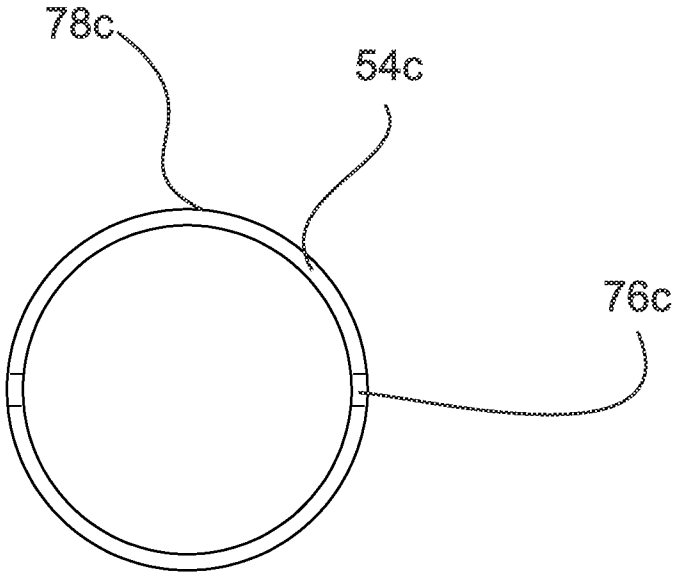
FIG. 10B is a view of the upper manifold section of the three stage version of this invention from one end.
Figure 10A:
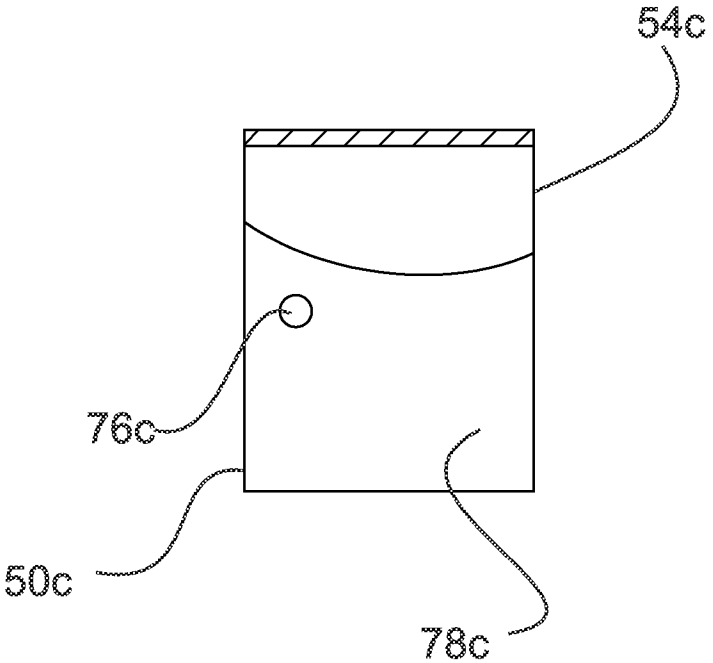
FIG. 10A is a side, partially cut away view of the upper manifold section of the three stage version of this invention.
Figure 11A:
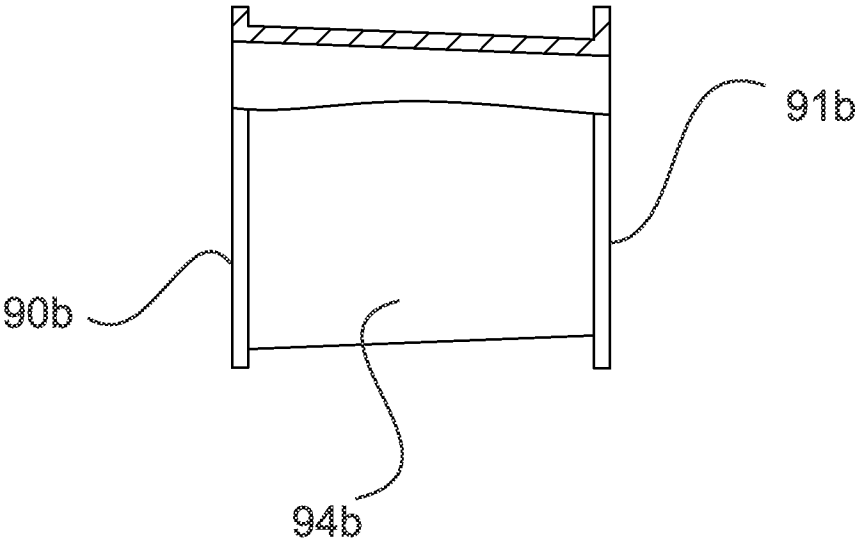
FIG. 11A is a side, partially cut away view of the middle connection tube of the three stage version of this invention.
Figure 11B:
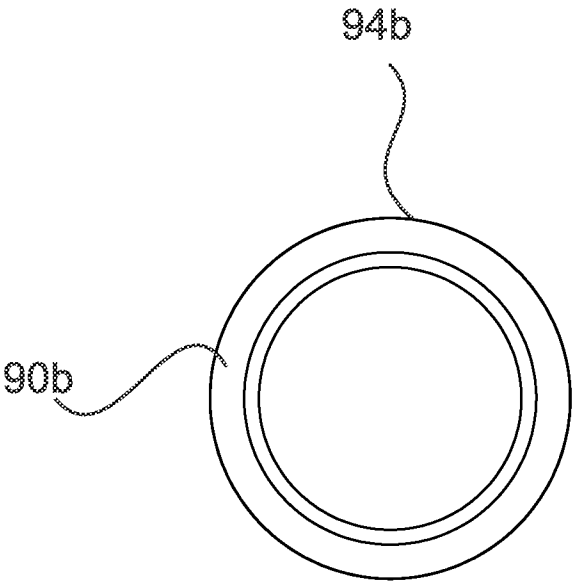
FIG. 11B is a view of the middle connection tube of the three stage version of this invention from one end.

The following parameterization in Cartesian coordinates defines the helix illustrated in FIG. 2:

$$x(t)=\cos(t),$$

$$y(t)=\sin(t),$$

$$z(t)=t.$$

As the parameter t increases, the point (x(t), y(t), z(t)) traces a right-handed helix of pitch 2π and radius 1 about the z-axis, in a right-handed coordinate system.

This invention 10 will be illustrated with a three stages 46 version. It will be obvious to those familiar with the art to which this invention pertains, that this invention 10 could have more that three stages 46. In the following description and the attached drawings, unless otherwise obvious, elements without a suffix are of similar design and function in each section 46. Reference numbers without a suffix will refer to that element generically. An "a" suffix to a reference number will, unless otherwise obvious, be used to designate elements of the first or lowest stage 46*a* of this invention 10; a "b" suffix to a reference number will, unless otherwise obvious, be used to designate elements of the second or middle stage 46*b* of this invention 10; and a "c" suffix to a reference number will, unless otherwise obvious, be used to designate elements of the third or upper stage 46*c* of this invention 10.

FIGS. 3, 4A, 4B, 5 and 6 show various views and features of the three stage 46 version of the invention 10. The three stages, 46*a*, 46*b*, 46*c* are connected together in series. Each stage 46 includes a manifold section 78, a venturi section 14 and a connecting tube 94. Each of these is tubular or annular in overall shape. FIGS. 8A, 8B, 9A, 9B, 9C, 9D, 9E, 10A, 10B, 11A, 11B, 12A, 12B, 12C, 12D, 12E, 13A, 13B, 14A, 14B, 15A, 15B, 15C, 15D, 16, 17A, 17B and 17C are detail views of all the components of this invention 10.

In each stage 46 the venturi section 14 fits inside the manifold section 78 and the front or lower flange 90 of the tubular section mates with the upper or rear surface of the venturi section 14 and the upper or rear surface 54 of the manifold section 78. The outside diameter of the venturi section 14 is slightly less than inside diameter of the manifold section so that it will fit snugly inside. Gaskets and bolts, O-rings and seals (not illustrated) are used between components in normal fashion in order to ensure a gas and liquid tight fit. Alternatively, a sealant may be used to join the sections and ensure a gas and liquid tight fit.

Each manifold section 78 has at least one radial hole 76 through it. It is through this hole that pressurized gas is introduced. Typically a fitting 80 is fitted to each hole 76. This fitting 80 is used to connect with a high pressure gas line (not illustrated).

Of course, the upper or rear flange 91*b* of the middle segment 46*b* is mated with front or lower surface 50*c* of the upper manifold section 78*c*. Also, there are one or more radial holes 72 in the lower manifold section 78*a*. These may be covered by a fluid inlet tube 74.

There may additionally be a nozzle 58 fitted to the lower surface 50*a* of the lower manifold section 78*a*. The outside and inside diameters of the nozzle 58 are larger at the inlet end 66 than at the outlet end 62. Further the outside of the nozzle 58 is shaped so that it fits inside and mates with the lower manifold section 78*a* and the lower venturi section 14*a*. Again, gaskets and bolts, O-rings and seals (not illustrated) are used between the nozzle 58 and the lower manifold section 78*a* and venturi section 14*a* in normal fashion in order to ensure a gas and liquid tight fit.

As has previously been described, each stage 46 of this invention 10 includes a Venturi section 14. A plurality of Venturi tubes 18 are spaced around the internal circumference of each Venturi section 14. Each of the Venturi tubes 18 has a helical shape, an outlet internal diameter at the outlet end 30*a* and an inlet internal diameter at the inlet end 26*a*. The outlet ends 30*a* of the Venturi tubes 18 are located adjacent the outlet ends 34 of the sections 14, and the inlet ends 26*a* are located adjacent the outlet ends 38*a* of the sections 14. In addition, the inlet diameters are larger than the outlet diameters.

Figure 12B:
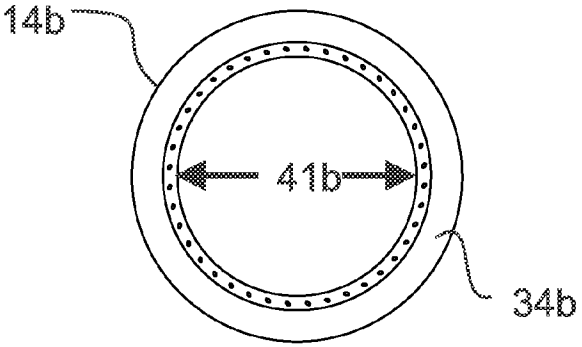
FIG. 12B is view of the middle venturi chamber of the three stage version of this invention from one end.
Figure 12A:
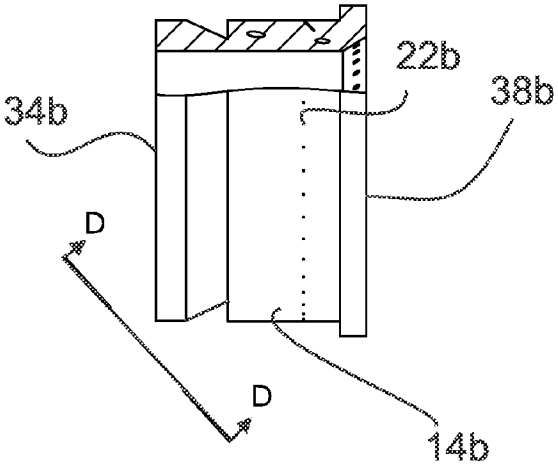
FIG. 12A is a side, partially cut away view of the middle venturi chamber of the three stage version of this invention.
Figure 12C:
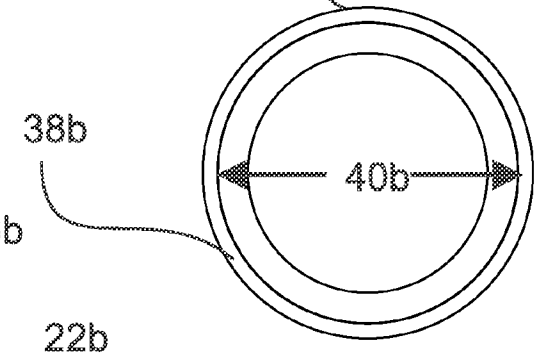
FIG. 12C is view of the middle venturi chamber of the three stage version of this invention from the other end.
Figure 12E:
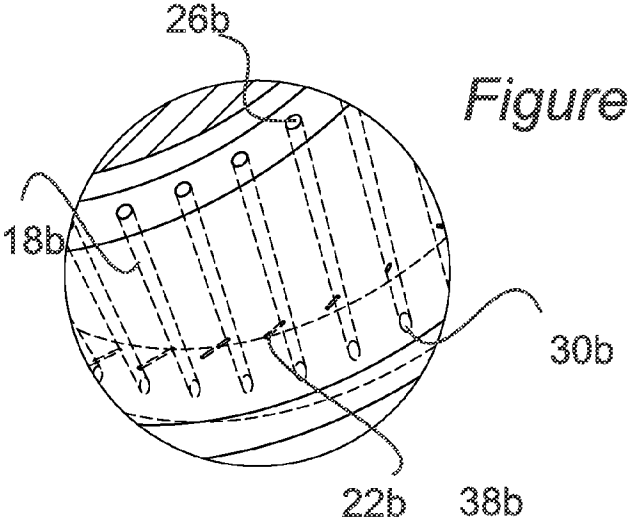
FIG. 12E is an enlargement of detail E on FIG. 12D.
Figure 12D:
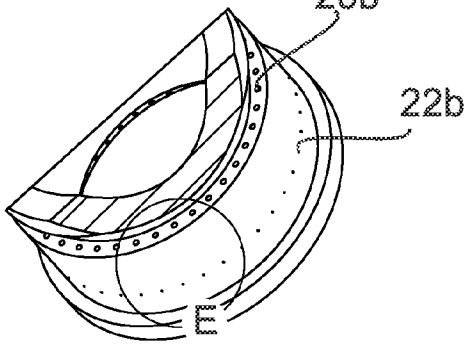
FIG. 12D is a view along the lines D-D of FIG. 12A.
Figure 13A:
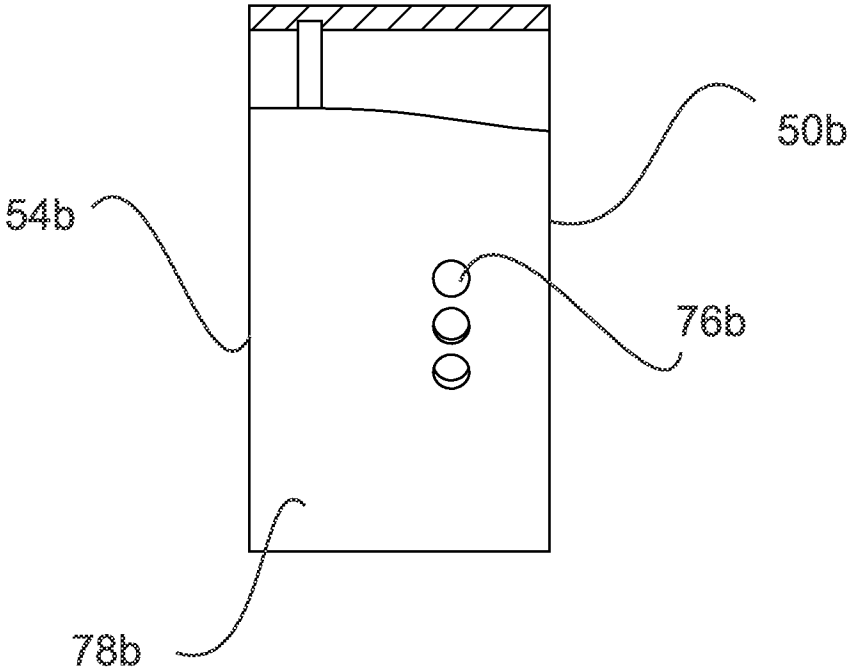
FIG. 13A is a side, partially cut away view of the middle manifold section of the three stage version of this invention.
Figure 13B:
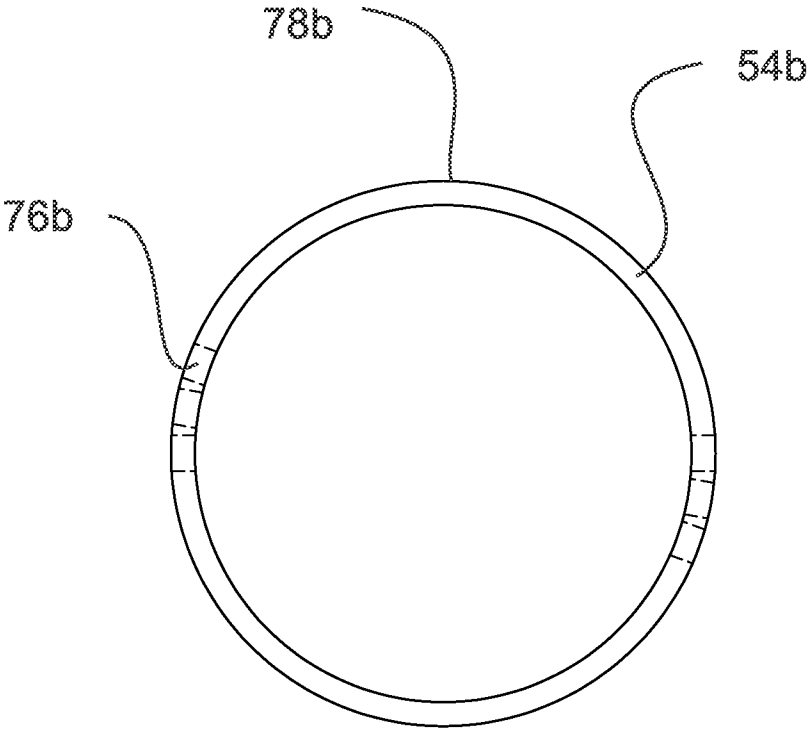
FIG. 13B is a view of the middle manifold section of the three stage version of this invention from one end.
Figure 14A:
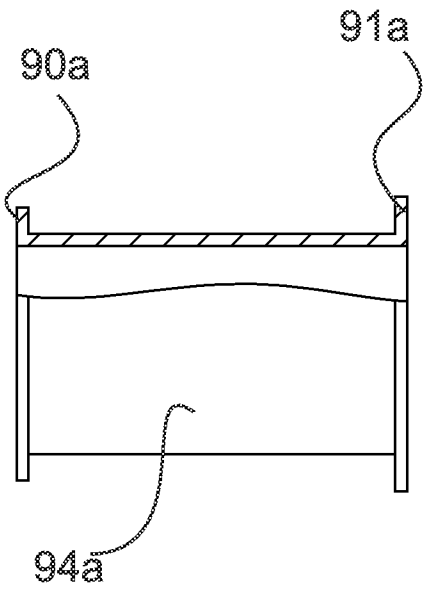
FIG. 14A is a side, partially cut away view of the lower connection tube of the three stage version of this invention.
Figure 14B:
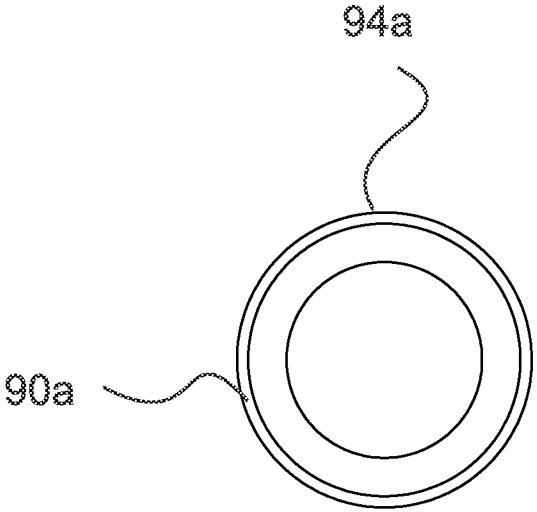
FIG. 14B is a view of the lower connection tube of the three stage version of this invention from one end.
Figure 15D:
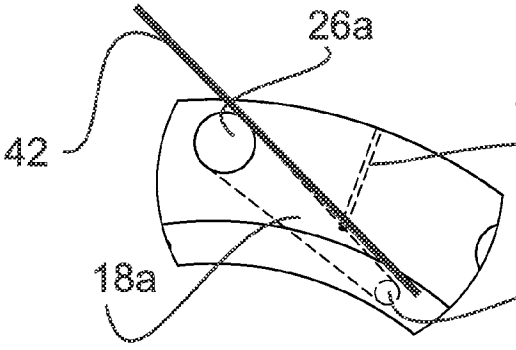
FIG. 15D is an enlargement of the detail shown at D on FIG. 15C. Some detail is omitted for clarity.
Figure 15C:
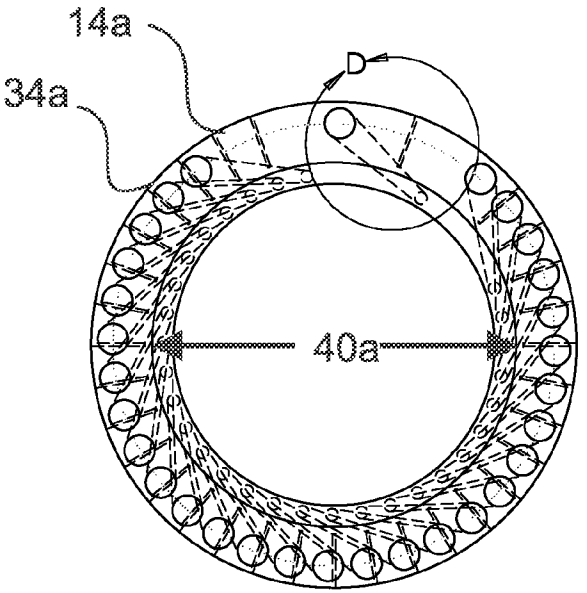
FIG. 15C is a view of the lower Venturi section of the three stage version of this invention from the other end. Some detail is omitted for clarity.
Figure 15A:
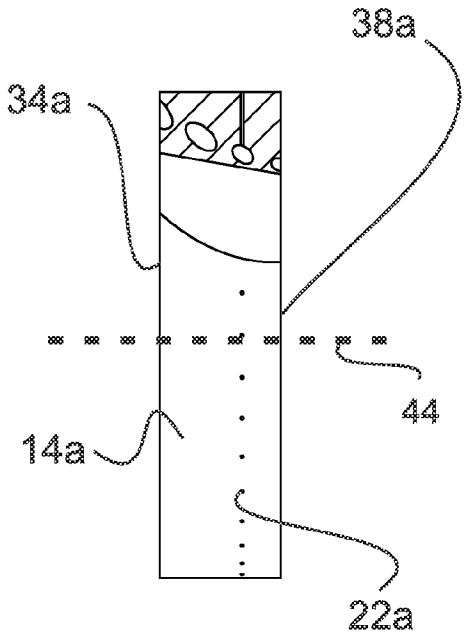
FIG. 15A is a side, partially cut away view of the lower Venturi section of the three stage version of this invention.
Figure 15B:
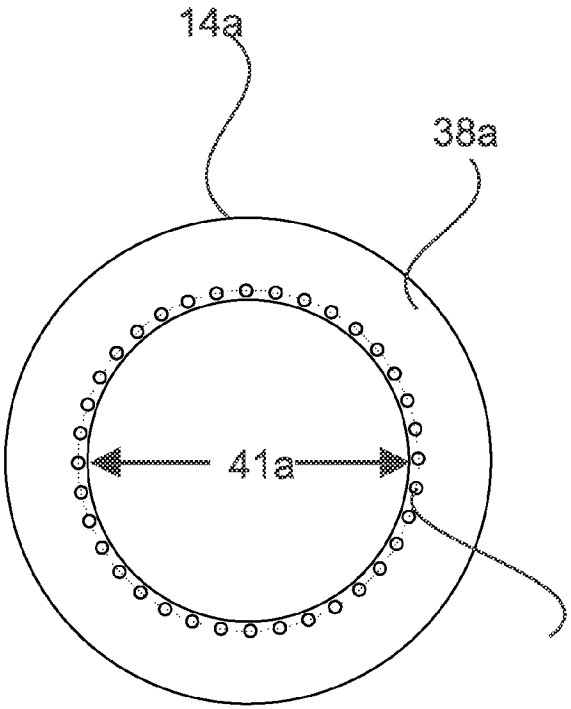
FIG. 15B is a side, partially cut away view of the lower Venturi section of the three stage version of this invention from one end.
Figure 16:
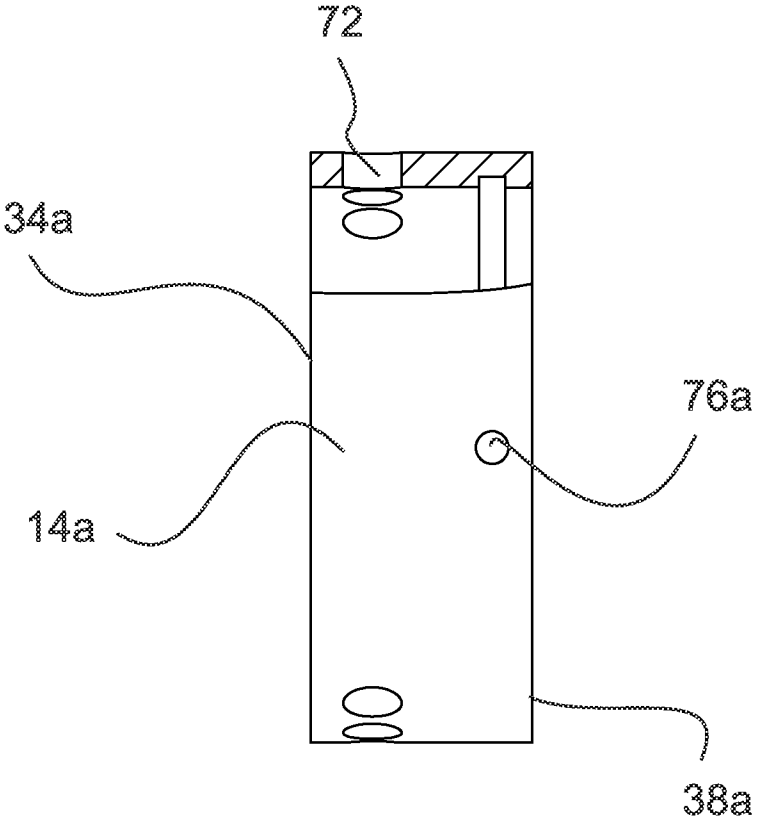
FIG. 16 is a side, partially cut away view of the lower manifold section of the three stage version of this invention.
Figures 17A, 17B, 17C:
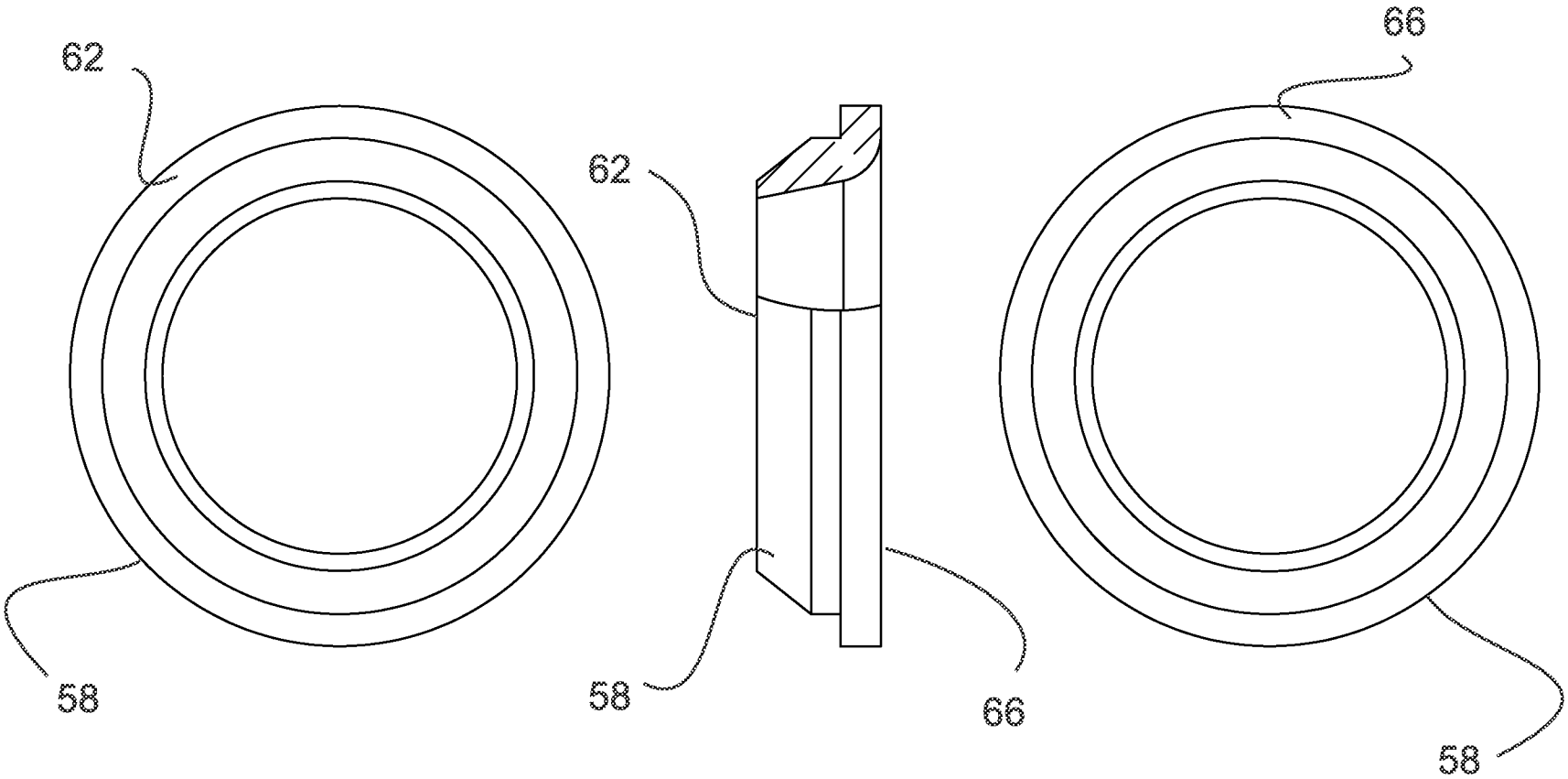
FIG. 17A is a side, partially cut away view of the inlet nozzle for this invention.
FIG. 17B is a view of the inlet nozzle for this invention from one end
FIG. 17C is a view of the inlet nozzle for this invention from the other end.

Further, in each venturi section 14 there are a plurality of air inlets 22 running at an angle between the outside of the section 14 and the venturi tubes 18. Such tubes 22 are best illustrated in FIGS. 12A, 12D and 12E.

In each Venturi section 14, the internal diameter 40 at the inlet 34 is larger than the internal diameter 41 at the outlet end 38. The path described by each Venturi tube 18 in each Venturi section is a helix. Also, each tube 18 decreases in diameter as it increases in displacement. The tubes 18 can have a right hand or left hand helical shape and preferably the tubes extend for less than one turn of the helix. The angle that the tangent 42 of the helix makes with the longitudinal axis 44 can be anywhere between 1° and 89°.

The internal configuration of each manifold section 78 and the external configuration of each corresponding venturi section 14 are designed to channel the high pressure gas from each high pressure inlet 76 to the inlet 26 of each venturi tube 18. To operate this invention 10, it is immersed in a fluid and pressurized gas is introduced into the inlet ends 26 of the tubes 18. Venturi action of the gas forces the fluid to move from the inlet ends 50 to the outlet ends 91 of each section. Preferably the fluid is water and the gas is compressed air.

The primary use for this invention is pumping or dredging of materials from the ocean floor. The high pressure gas will typically be provided by an air compressor. Tubing (not illustrated), preferably flexible tubing will be connected from the air compressor to each fitting 80. In addition there will be another flexible tube (not illustrated) connecting the uppermost flange 91*c* to a location where it is desired to deposit the material to be pumped.

When everything is ready the pump will be lowered into the water to the desired depth and the air compressor activated. The compressed air will flow through the venturi tubes 18 and the air inlets 22. The venturi effect of the gas on the water will suck the water etc. in to the inlet end of the invention, preferably the inlet end 66 of the nozzle 58, and expel it from the outlet end 91*c*. From here the material will move through the long tube and be deposited at the desired location. The gas tends to stay close to the inner walls of the tubes 94 and venturi sections, thus reducing friction and providing protection from the material being pumped. If the inlet end 66 of the invention gets plugged with material, lifting it slightly to allow the side wall openings 72 to clear the material will allow clear water to be sucked into the pump thus clearing it.

The preferred design parameters for the pump version of this invention 10 are as follows:

| Stage | Internal diameter 40 or 41 | No. of Venturi tubes 18 | Internal diameter of tube at inlet 26 | Internal diameter of tube at outlet 30 | Angle of helix tangent 42 to axis 44 |
|---|---|---|---|---|---|
| I - bottom 46a | 20" | 45 | 1" | ⅝" | 60° |
| II - intermediate 46b | 12" | 36 | ⅜" | ¼" | 70° |
| III - top 46c | 10" | 36 | ½" | ¼" | 80° |

Figure 18:
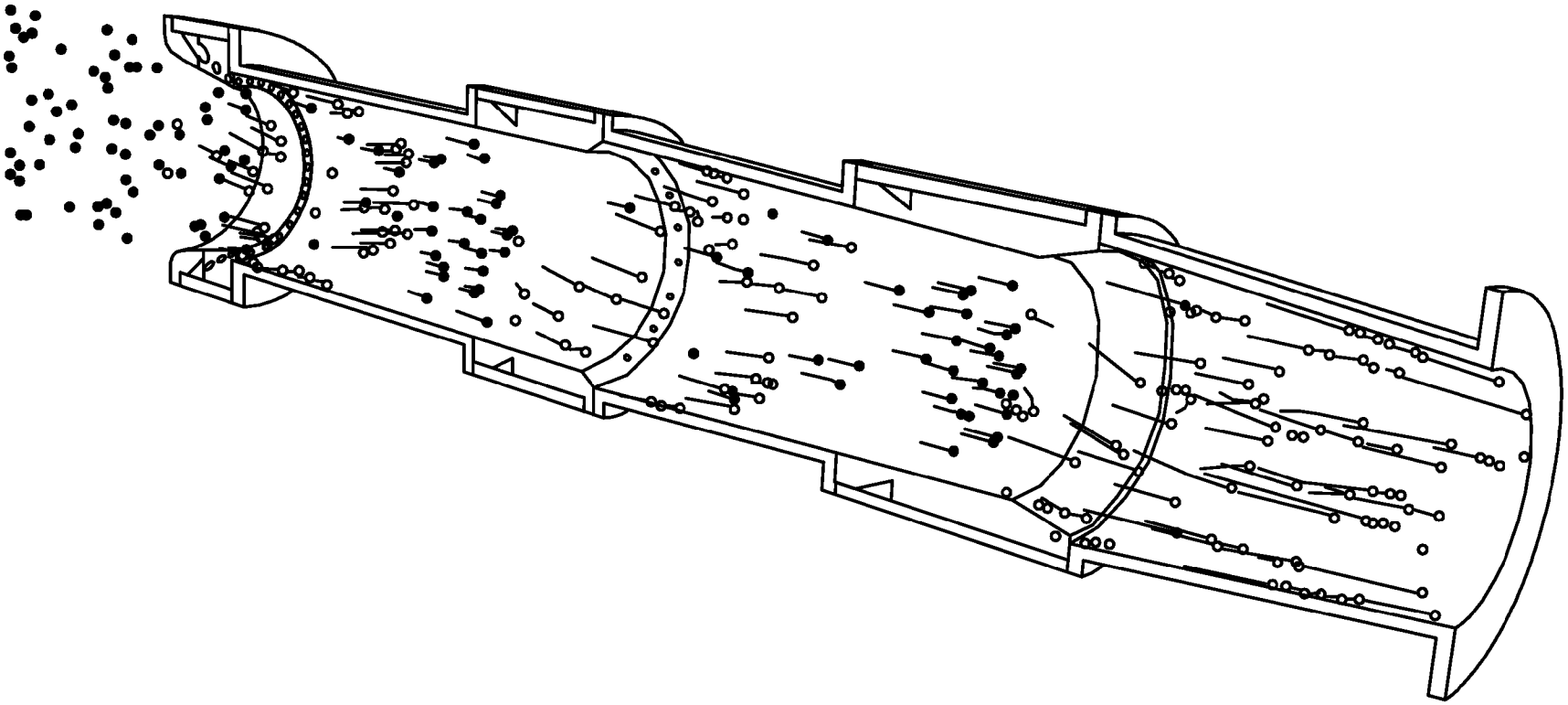
FIG. 18 is a perspective, cutaway view showing how air and water move through the invention.

FIG. 18 is a perspective, cutaway view showing how air and water move through the invention. Air is indicated by the darker arrows, water by the lighter arrows. Gas injection is scaled among the different orifice levels in proportion to the inward orifice area as follows:

Flow rate at first level venturis 18*a* 1.47978 m3/sec 52.26%

Flow rate at second level venturis 18*b* 2 0.42749 m3/sec 15.10%

Flow rate at third level venturis 18*c* 0.65585 m3/sec 23.16%

Flow rate at third level air inlets 22*c* 4 0.26855 m3/sec 9.48%

Total air flow rate 2.83168 m3/sec 6000.00 cfm

Figure 19:
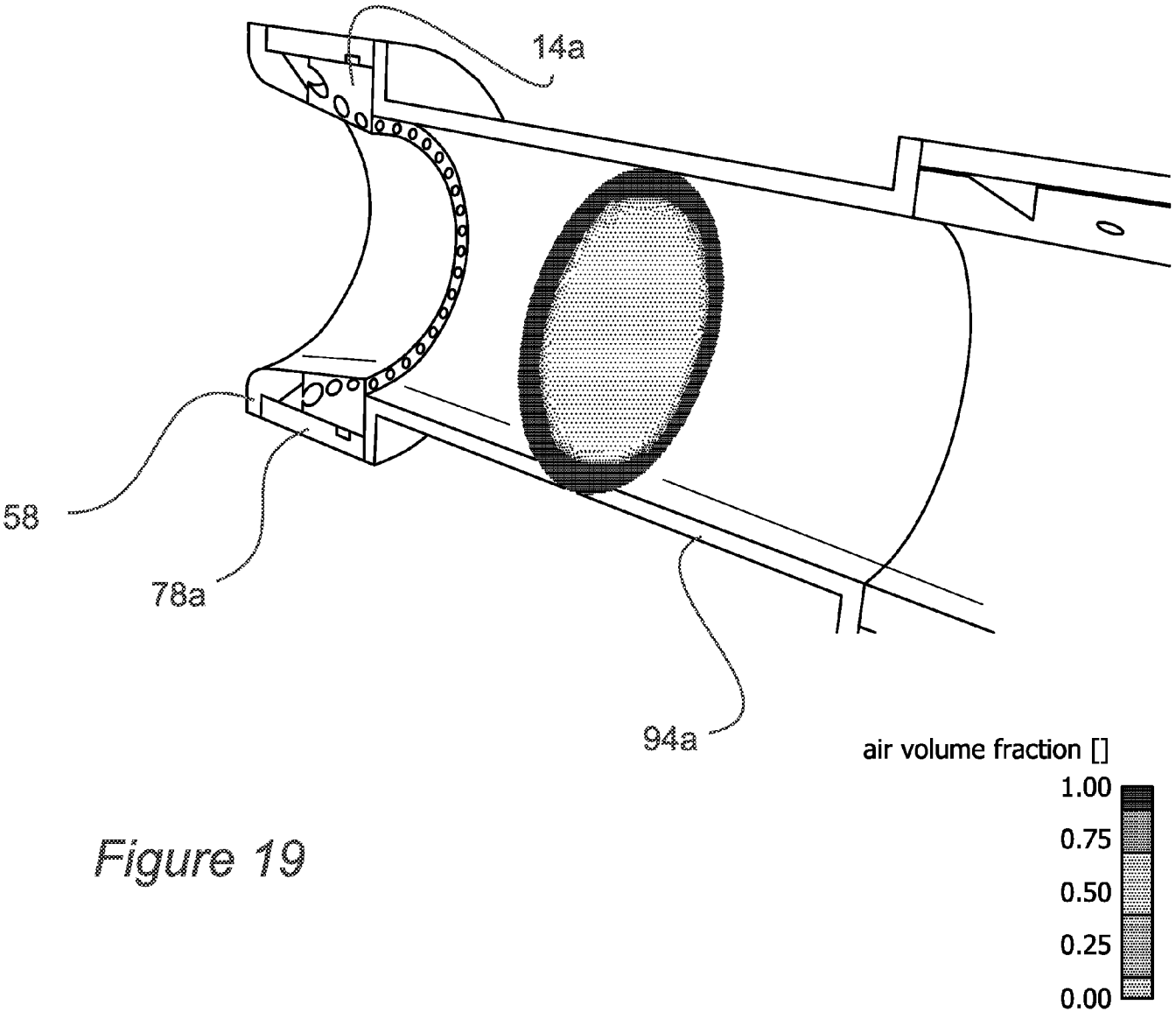
FIG. 19 is a perspective, cutaway view showing how air and water are diametrically distributed across the cross section in the lower section of the invention.
Figure 20:
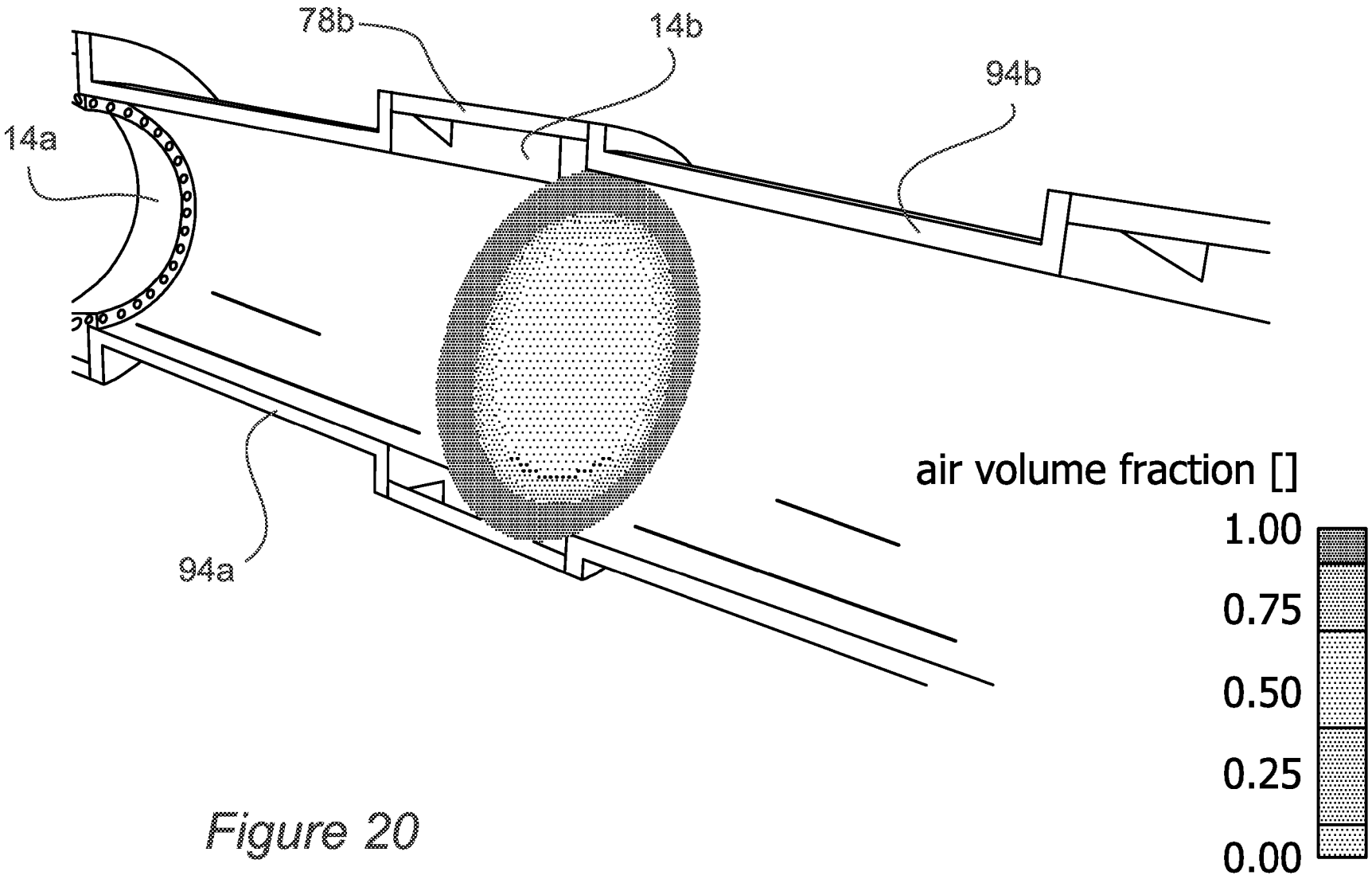
FIG. 20 is a perspective, cutaway view showing how air and water are diametrically distributed across the cross section at the junction of the middle and upper sections of the invention.
Figure 21:
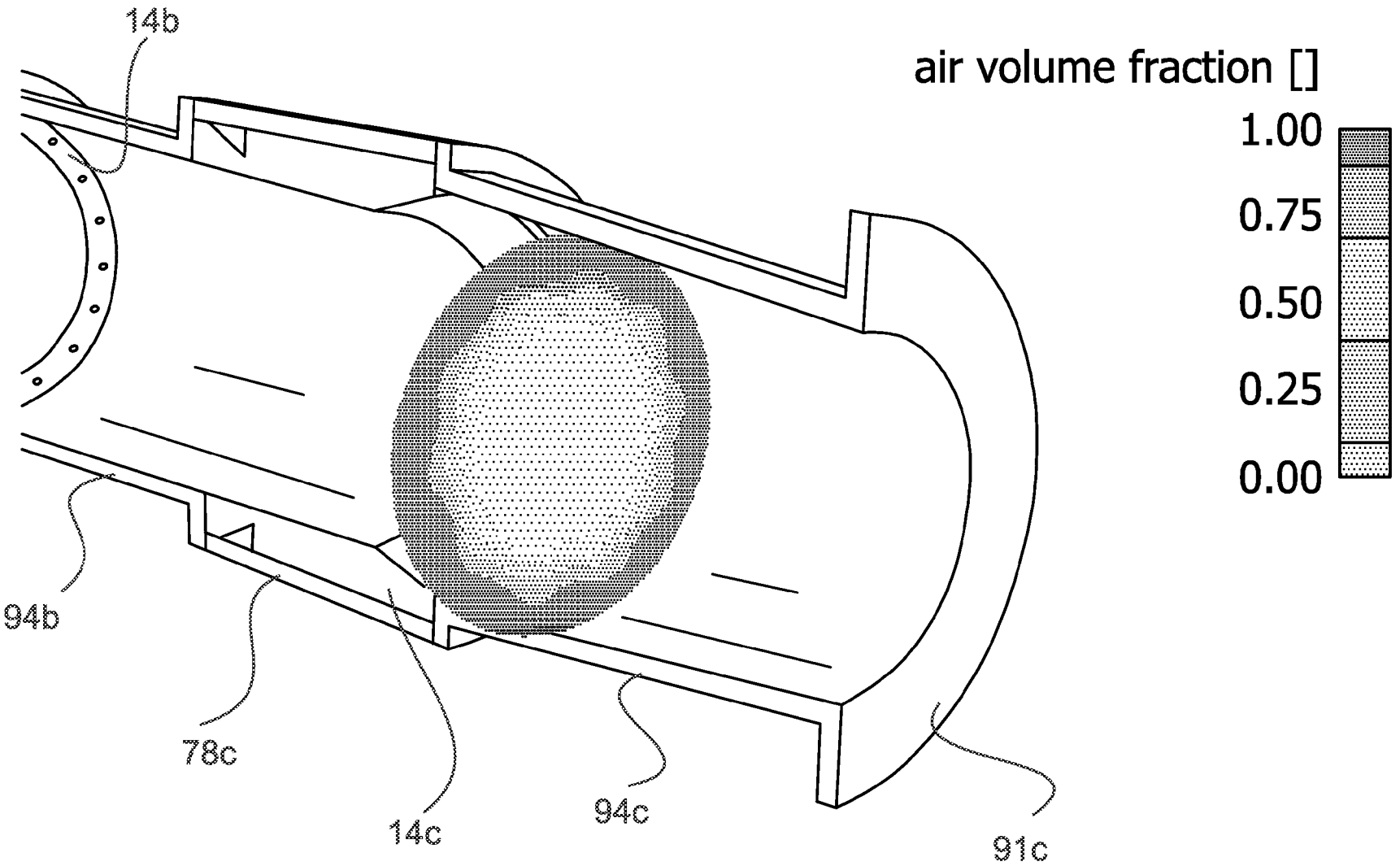
FIG. 21 is a perspective, cutaway view showing how air and water are diametrically distributed across the cross section in the outlet tube section of the invention.
Figure 22:
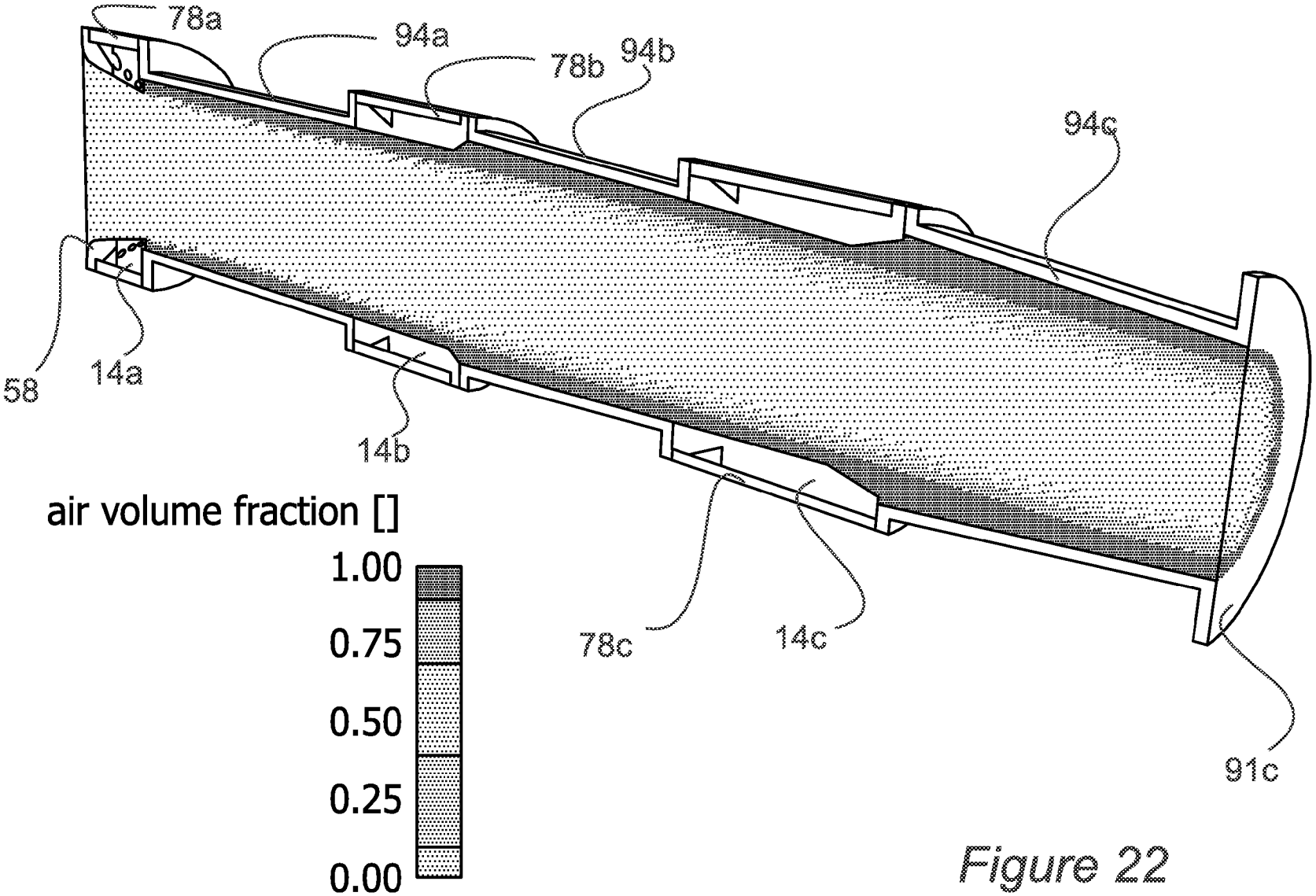
FIG. 22 is a perspective, cutaway view showing how air and water are longitudinally distributed across the cross section in the outlet tube section of the invention.

FIGS. 19-21 are perspective, cutaway views showing how air and water are diametrically distributed across the cross sections of the invention 10. FIG. 22 is a perspective, cutaway view showing how air and water are longitudinally distributed along the invention 10. It can be seen from the keys in the drawings that most air flows along the walls of the invention. As the air flows it sucks the water along with it upwards.

The pump version of this invention is designed to suck materials off the ocean floor at depths of 10,000' or more. It will operate without creating turbidity and will produces a fluid flow of 20,000 gals./min. with an air flow of 6,000 cu.ft./min. at sea level. At depth static pressure will have an influence necessitating less air and higher fluid flow, for example 40,000 gals/min or more.

The following reference numerals are used on the Figures:

10 this invention
14 venturi section
18 venturi tube
22 air inlet
26 inlet end of venturi tube
30 outlet end of venturi tube
34 lower or inlet surface of venturi section
38 upper or outlet surface of venturi section
40 internal diameter of inlet end of venturi section
41 internal diameter of outlet end of venturi section
42 tangent of the helix
44 longitudinal axis of helix
46 stage of invention
50 inlet surface of manifold section
54 outlet surface of manifold section
58 nozzle
62 outlet surface of nozzle
66 inlet surface of nozzle

72 side inlet opening
74 fluid inlet
76 gas inlet
78 manifold section
90 lower or inlet flange
91 outlet or upper flange
94 connection tubing The suffix "a" added to a reference numeral indicates first or lowest stage; the suffix "b" the middle or second stage; and the suffix "c" the outlet, third or upper stage.

Thus, the present invention 10 has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for pumping fluid comprising:

a) a cylindrical chamber having an internal circumference, a longitudinal axis, an inlet flange and an outlet flange; said flanges being at 90 degrees to said cylindrical chamber;

b) an annular manifold attached to said inlet flange;

c) an annular Venturi section within said manifold having a wall, a second internal circumference, an inlet end, an outlet end and a second longitudinal axis; said second longitudinal axis being in line with said longitudinal axis;

d) a plurality of Venturi tubes within said wall spaced around said second internal circumference; each of said Venturi tubes having a helical shape; each of said Venturi tubes having an inlet diameter at said inlet end and an outlet diameter at said outlet end; said inlet diameter being larger than said outlet diameter; said manifold connected to said inlet ends; and e) a high pressure gas supply for supplying gas under high pressure, connected to said manifold.

2. An apparatus as claimed in claim 1 in which said Venturi tubes extend for less than one turn of said helix.

3. An apparatus as claimed in claim 1 in which said helix is right handed or left handed.

4. An apparatus as claimed in claim 1 in which said internal circumference is larger at said inlet end than at said outlet end.

5. An apparatus as claimed in claim 1 in which said fluid is water.

6. An apparatus as claimed in claim 1 in which said gas is air.

7. An apparatus as claimed in claim 1 in which the angle that the tangent said helical shape makes with said second longitudinal axis is between 1° and 89°.

8. An apparatus as claimed in claim 1 further comprising a plurality of air inlets through said wall wherein each of said air inlets is connected to said manifold at one end and each respective venturi tube at the other end.

9. An apparatus as claimed in claim 1 further comprising a nozzle attached to said inlet end; said nozzle having a tubular shape, a nozzle circumference, a nozzle inlet end, a nozzle outlet end and a side wall.

10. An apparatus as claimed in claim 9 in which said nozzle outlet circumference matches said second internal circumference at said outlet end.

11. An apparatus as claimed in claim 9 in which said nozzle circumference is larger at said nozzle inlet end than at said nozzle outlet end.

12. An apparatus as claimed in claim 9 further comprising an opening in the side wall.

13. An apparatus comprising at least two of said apparati, as described in claim 1 connected together in series.

14. A method for pumping fluid comprising the steps of:

a) fabricating a cylindrical chamber having an internal circumference, a longitudinal axis, an inlet flange and an outlet flange; said flanges being at 90 degrees to said cylindrical chamber;

b) fabricating an annular manifold having a manifold longitudinal axis and a manifold inlet designed to attach to said inlet flange; said manifold longitudinal axis being in line with said longitudinal axis; said manifold inlet having a manifold inlet longitudinal axis in line with said manifold longitudinal axis;

c) fabricating an annular venturi section designed to fit inside said annular manifold; said annular venturi section having a wall, a second internal circumference, an inlet end, an outlet end and a second longitudinal axis; said second longitudinal axis being in line with said longitudinal axis said annular venturi section having a plurality of venturi tubes within said wall spaced around said second internal circumference; each of said venturi tubes having a helical shape; each of said venturi tubes having an inlet diameter at said inlet end and an outlet diameter at said outlet end; said inlet diameter being larger than said outlet diameter;

d) attaching said annular manifold to said inlet flange;

e) placing said venturi section within said manifold whereby said inlet end is connected to said manifold;

f) providing a high pressure gas supply;

g) connecting said high pressure gas supply to said manifold;

h) placing said inlet end in said fluid;

i) supplying a gas under high pressure to said high pressure gas supply; and j) activating said high pressure gas supply with high pressure gas; whereby said fluid will be sucked in to said inlet end and expelled from said outlet end by venturi effect of said gas on said fluid.

15. A method as claimed in claim 14 in which said venturi tubes extend for less than one turn of said helix.

16. A method as claimed in claim 14 in which said helix is right handed or left handed.

17. A method as claimed in claim 14 in which said internal circumference is larger at said inlet end than at said outlet end.

18. A method as claimed in claim 14 in which said fluid is water.

19. A method as claimed in claim 14 in which said gas is air.

20. A method as claimed in claim 14 in which the angle that the tangent said helical shape makes with said longitudinal axis is between 1° and 89°.

21. A method as claimed in claim 14 further comprising the step of fabricating a plurality of air inlets through said wall wherein each of said air inlets is connected to said manifold at one end and each respective venturi tube at the other end.

22. A method as claimed in claim 14 further comprising the steps of:

a) fabricating a nozzle having a tubular shape, a nozzle circumference, a nozzle inlet end, a nozzle outlet end and a side wall; and b) attaching said nozzle to said inlet end.

23. A method as claimed in claim 22 in which said nozzle outlet circumference matches said second internal circumference at said outlet end.

24. A method as claimed in claim 22 in which said nozzle circumference is larger at said nozzle inlet end than at said nozzle outlet end.

25. A method as claimed in claim 22 further comprising the step of cutting at least one opening in the side wall.

26. A method comprising the step of connecting at least two of said apparati, as described in claim 14 together in series; whereby the effect of venturi action of said gas on said fluid is multiplied and said fluid will be propelled even faster.

* * * * *